US005150766A

United States Patent [19]

Bell

[11] Patent Number: 5,150,766

[45] Date of Patent: Sep. 29, 1992

[54] SLIDING ANCHOR SYSTEM AND METHOD OF USE

[76] Inventor: Michael Bell, 1705 Triumphe Way, Warrington, Pa. 18976

[21] Appl. No.: 771,666

[22] Filed: Oct. 4, 1991

[51] Int. Cl.[5] ..... A62B 1/20

[52] U.S. Cl. ..... 182/100; 182/112; 182/190; 24/115 G

[58] Field of Search ..... 182/100, 189, 3, 5, 182/190, 112; 24/115 G, 300, 115 A

[56] References Cited

U.S. PATENT DOCUMENTS

| | | | |
|---|---|---|---|
| 280,065 | 6/1883 | Morford | 182/190 |
| 814,472 | 3/1906 | Noonan | 182/190 |
| 1,351,734 | 9/1920 | Barrington | 182/5 |
| 2,205,933 | 6/1940 | Silvia | 182/112 |
| 4,090,584 | 5/1978 | Wagner | 182/5 |
| 4,560,029 | 12/1985 | Dalmaso | 182/112 |
| 4,789,045 | 12/1988 | Pugh | 182/100 |
| 4,864,695 | 9/1989 | Gold | 24/300 |

*Primary Examiner*—Reinaldo P. Machado

*Attorney, Agent, or Firm*—Caesar, Rivise, Bernstein, Cohen & Pokotilow, Ltd.

[57] ABSTRACT

An anchor system and method of use for securement to a fixed anchor point at an elevated position on a structure. The system comprises a rope arranged to be extended between the elevated position and a lower position, and slidable connection device. The connection device is arranged to be releasably secured to the fixed anchor point and comprises a flexible tubular member woven of strands of fibers. The tubular member has a pair of ends, each of which includes an extension projecting therefrom. Each extension is bent back over itself and inserted into the tubular member to form a loop. A connector is mounted on one of the loops and is arranged to be releasably secured to the fixed anchor. The rope extends through the tubular member, with the tubular member having a sufficiently large internal diameter that the rope may slide therethrough. The tubular member is arranged to be contracted radially inward upon the application of a pulling force to each of its ends, whereupon the internal diameter is reduced so that the rope is tightly frictionally engaged to preclude it from sliding therethrough.

22 Claims, 2 Drawing Sheets

SLIDING ANCHOR SYSTEM AND METHOD OF USE

BACKGROUND OF THE INVENTION

This invention relates generally to safety apparatus and more particularly to a device for slidable mounting on a safety line to serve as an adjustable anchor point for connection to a building or other structure.

As a result of the enactment of various safety laws persons working at elevated height positions, e.g., on steel construction beams of a building as it is erected, etc., are required to be protected against falls. One common approach to achieve that end is the use of a safety line or cable which is connected to a fixed anchor point on the building and which is dropped down to the ground so that it extends between the elevated position and the ground. This line may serve as a line on which a conventional "rope grab" device or a conventional lowering device, e.g., a SKY GENIE (Registered Trademark) device sold by Descent Control, Inc. of Fort Smith, Ark., is mounted. Typically such safety lines are formed of a braided synthetic material, e.g., nylon, polyester, etc.

As will be appreciated by those skilled in the art, when such lines are knotted, as would be necessary to secure the line to the anchor point, such action substantially reduces the load bearing ability of the line.

The prior art has not addressed the foregoing problem in an adequate manner heretofore.

OBJECTS OF THE INVENTION

Accordingly, it is a general object of this invention to provide an anchor system which overcomes the disadvantages of the prior art.

It is a further object of this invention to provide an anchor system which can be readily slid to a desired position on a conventional safety line and once located in that position can be secured in place on the line and then connected to a fixed anchor point, so that the line cannot slip with respect to the anchor point, all without requiring the knotting of the line to fix it to the anchor point.

It is still a further object of this invention to provide an anchor system which is very simple in construction, and easy to connect to a conventional safety line and to a fixed anchor point to secure the line to that point.

SUMMARY OF THE INVENTION

These and other objects of this invention are achieved by providing an anchor system and method of use for securement to a fixed anchor point located at an elevated position on a structure.

The system comprises a rope arranged to be extended between the elevated position and a lower position, and slidable connection means. The slidable connection means is arranged to be releasably secured to the fixed anchor point and comprises a flexible tubular member woven of strands of fibers. The tubular member has a pair of ends, with a first one of the ends including an extension projecting therefrom. That extension comprises a connector arranged to be releasably secured to the fixed anchor point. The rope extends through the tubular member. The tubular member has a sufficiently large internal diameter when its length is compressed so that the rope may slide therethrough. That member is arranged to be contracted radially inward upon the application of a pulling force to each of its ends, whereupon the length of the member is extended and its internal diameter is reduced so that the rope extending through it is tightly frictionally engaged by it to preclude the rope from sliding therethrough.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
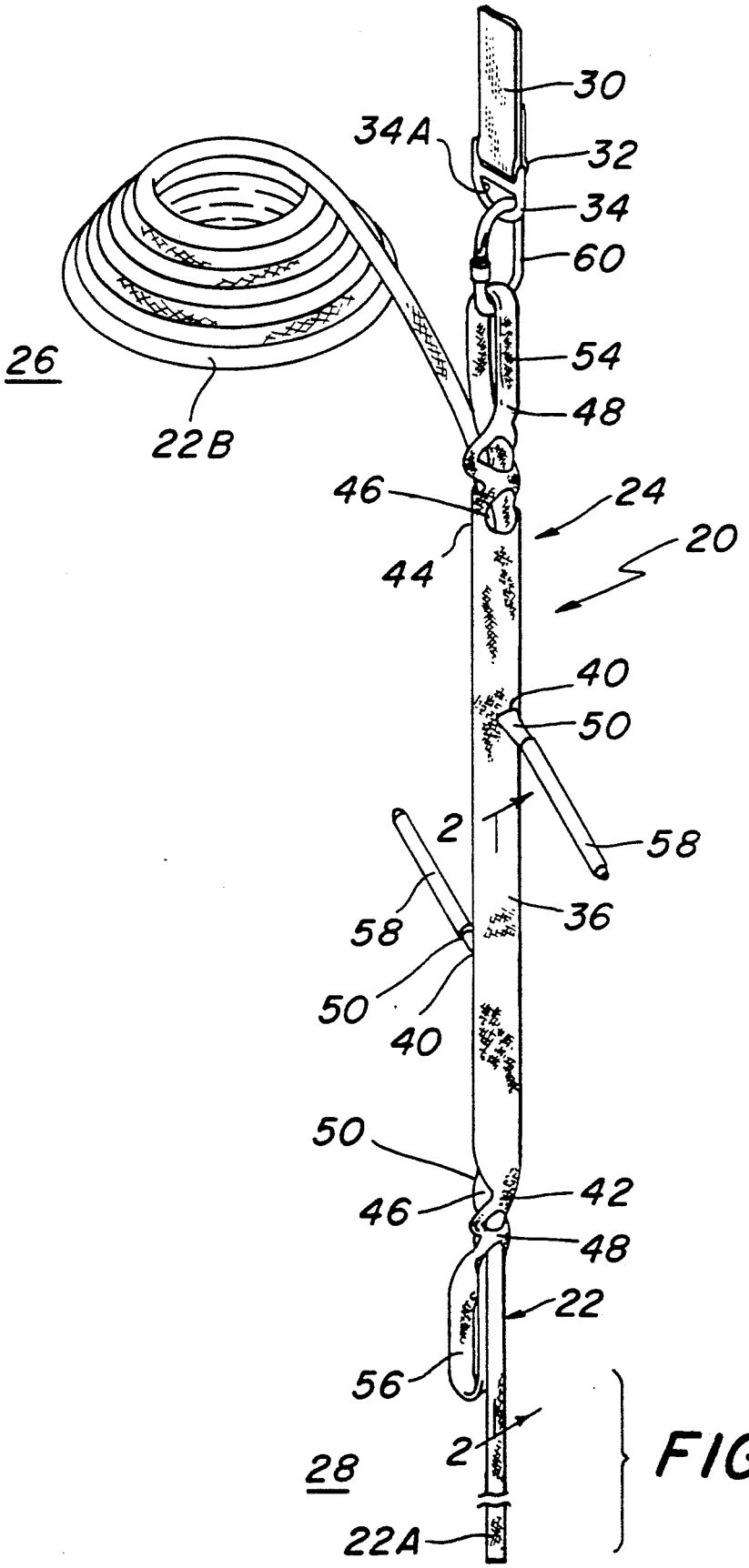
FIG. 1 is a side elevational view of an anchoring system constructed in accordance with this invention.

Referring now to the drawing where like reference numerals refer to like parts there is shown at 20 in FIG. 1, an anchoring system constructed in accordance with this invention. The system 20 basically comprises a rope 22 and a connection device 24. The rope is of conventional construction. Thus, in the preferred embodiment of this invention the rope is woven of a high strength synthetic material, e.g., nylon or polyester. The rope 22 is arranged to be extended between the elevated position 26, such as on an upper floor of a building (not shown), and a lower position 28, e.g., the ground, to provide a safety line as is conventional.

The connection device 24 is arranged to be mounted on the rope to serve as a means for connecting the rope to a fixed anchor point on the building. The fixed anchor point may comprise an I-beam or some other strong, stationary member. In the embodiment shown herein a connection to the anchor point is effected by a strap 30 woven of a high strength material, e.g., nylon or polyester, having a free end 32 at which a conventional metal D-shaped connector 34 is mounted. The strap 30 is arranged to be secured to the anchor point in any suitable manner, e.g., it may be looped around an I-beam, etc., and locked in place by any suitable means (not shown). This arrangement produces a fixed anchor or connecting point, to which the connection device 24 of this invention is arranged to be releasably secured.

The connection device 24 basically comprises an elongated, e.g., 4 foot (122 cm), flexible tubular member 36 woven of plural strands of fibers. The fibers may be single or multiple filaments and are composed of a strong, light weight, material, e.g., nylon, polyester, KEVLAR (Registered Trademark), etc. The strands making up the tubular member 36 are woven or interconnected like a conventional "chinese finger grip". Thus, the member 24 has a central passageway 38 (FIGS. 2–4) extending through it between a pair of ends 42 and 44. Each of the ends 42 and 44 includes an opening 46 to the interior of the central passageway and an associated projection 48 extending from the edge of the opening 46. In the preferred embodiment each projection 48 merely comprises an extension of the woven tubular member 36.

Figure 2:
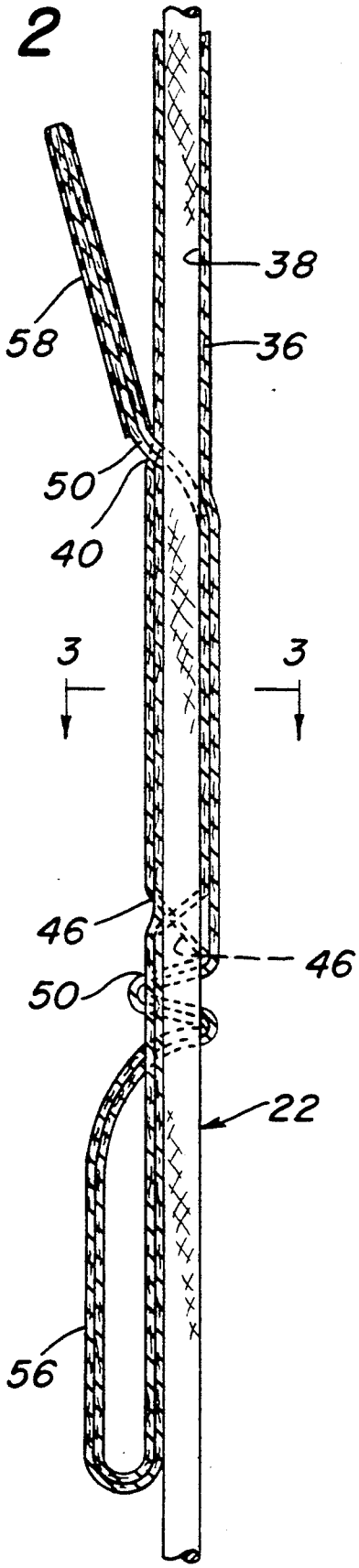
FIG. 2 is an enlarged sectional view taken along lines 2—2 of FIG. 1.
Figure 3:
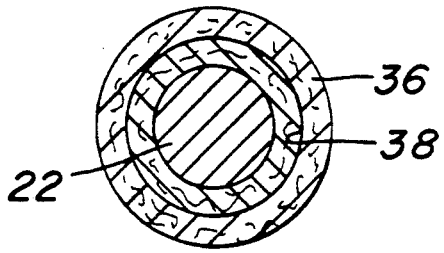
FIG. 3 is an enlarged sectional view taken along lines 3—3 of FIG. 2, when the rope is tightly held in the device.

As seen clearly in FIGS. 1 and 2, the free end portion 50 of each extension 48 is bent back over itself and inserted through its associated opening 46 into the interior of passageway in the tubular member 36 and out through an associated hole 40 in the side of the tubular member adjacent the end from which the extension projects. This arrangement forms a loop at each end of the tubular member. In particular, the extension at the top end of the tubular member 36 forms a loop 54, while the extension at the bottom of the tubular member forms a loop 56. The tip of each free end portion 50 is capped by a plastic cap 58 to facilitate the insertion of the extension through the central passageway and out the opening 40 in the side of the tubular member.

In accordance with a preferred embodiment of this invention the tubular member 36 may be constructed of a YALEGRIP (Trademark) "grip" or "stopper" sold by Yale Cordage, Inc. of Old Sparhawk Mill, Yarmouth, Me., 04096.

An openable/closeable connector, such as a conventional clip or carabiner 60, is mounted on the upper loop 54. The carabiner 60 is arranged to be releasably secured to D-shaped connector 34 at the fixed anchor point by opening it up, extending it through the opening 34A in the connector 34 and then closing and locking it. This secures the connection device 24 to the anchor point to preclude the device from moving.

Figure 4:
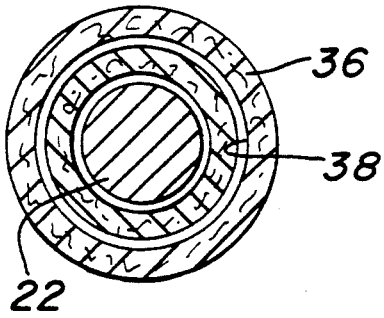
FIG. 4 is an enlarged sectional view similar to that of FIG. 3 and taken along line 3—3 of FIG. 1, when the rope is free to slide in the device.

The rope 22 is arranged to be extended (slipped) through the central passageway 38 in tubular member 36. To accomplish that action the two ends 42 and 44 of the tubular member are pushed towards each other. This causes the elongated tubular member 36 to decrease in length and increase in diameter, so that the internal diameter of its central passageway is greater than the external diameter of the rope as shown in FIG. 4. One end of the rope can then be extended (slipped) into an opening 46 and slid through the central passageway 38. Once the rope's end extends out the opposite hole 46, it may be pulled until its lower end 22A is located at the desired lower elevation, e.g., ground 28. The remainder of the coil 22B of rope 22 may be left at the elevated position 26.

In order to fix or secure the rope 22 within the connection device 24 so that it cannot slide with respect thereto, all that is necessary is to pull the ends 42 and 44 of the connector device apart by gripping the loops 54 and 56 and pulling them away from each other. This action causes the tubular member 36 to elongate, and its central passageway to constrict in internal diameter (like that shown in FIG. 3), whereupon, the interior surface of the central passageway 38 tightly engages the exterior surface of the rope 22. The resulting high friction created by this action precludes the rope from sliding within the central passageway in the tubular member 36. Thus, the rope will now be strongly secured to the anchor point and resistant to movement.

In order to release the high frictional engagement between the connector device 24 and the rope 22 extending therethrough, such as would be desired to shorten or extend the rope or to disconnect the rope from the device, all that is necessary is to grasp the ends of the tubular member 36 and push them towards each other. This action compresses the length of the tubular member, thereby increasing the internal diameter of its central passageway (like that shown in FIG. 4) and breaking the frictional engagement between the rope and it, so that the rope can be readily slid therethrough.

As will be appreciated from the foregoing, the anchor system of this invention is simple in construction, relatively low in cost, light in weight, easy to use, and provides safe and effective manner for securing a flexible rope or line to some fixed anchor point without necessitating the knotting of the line or in any way compromising its load handling ability.

Moreover, it should be appreciated by those skilled in the art that the slidable connection device of this invention need not be used in the anchor system as described above. Thus, the slidable connection device can also be used for other applications, e.g., as a viable means for readily, releasably grasping a flexible cable, such as, an electrical cable, to pull it through some path, e.g., the ground. Moreover, a pair of such slidable connection devices may be located at spaced positions on a rope or cable to tightly string the rope or cable between two predetermined points, without having to knot the cable.

Without further elaboration the foregoing will so fully illustrate my invention that others may, by applying current or future knowledge, adopt the same for use under various conditions of service.

I claim:

1. An anchor system for securement to a fixed anchor point at an elevated position on a structure, said system comprising a rope arranged to be extended between said elevated position and a lower position, and slidable connection means, said slidable connection means being arranged to be releasably secured to said fixed anchor point and comprising a flexible tubular member woven of strands of fibers, said tubular member having a pair of ends, a first one of said ends including an extension projecting therefrom, said one extension comprising a connector arranged to be releasably secured to said fixed anchor, said rope extending through said tubular member, said tubular member when compressed longitudinally having a sufficiently large internal diameter that said rope means may slide therethrough, said tubular member being arranged to be extended longitudinally upon the application of a pulling force to each of said ends, whereupon said internal diameter is reduced so that said rope is tightly frictionally engaged by said tubular member to preclude said rope means from sliding through said tubular member.

2. The anchor system of claim 1 wherein said one extension has a free end, said free end being disposed within the interior of said tubular member adjacent said one end to form a loop.

3. The anchor system of claim 2 and wherein said connector is mounted on said loop.

4. The anchor system of claim 1 wherein said other end includes another extension projecting therefrom.

5. The anchor system of claim 4 wherein said other extension has a free end, said free end being disposed within the interior of said tubular member adjacent said other end to form a loop.

6. The anchor system of claim 2 wherein said other end includes another extension projecting therefrom.

7. The anchor system of claim 6 wherein said other extension has a free end, said free end being disposed within the interior of said tubular member adjacent said other end to form a loop.

8. The anchor system of claim 3 wherein said other end includes another extension projecting therefrom.

9. The anchor system of claim 8 wherein said other extension has a free end, said free end being disposed within the interior of said tubular member adjacent said other end to form a loop.

10. The anchor system of claim 1 wherein said internal diameter is increased when said ends are pushed towards each other.

11. The anchor system of claim 10 wherein said one extension has a free end, said free end being disposed within the interior of said tubular member adjacent said one end to form a loop.

12. The anchor system of claim 11 and wherein said connector is mounted on said loop.

13. The anchor system of claim 10 wherein said other end includes another extension projecting therefrom.

14. The anchor system of claim 13 wherein said other extension has a free end, said free end being disposed within the interior of said tubular member adjacent said other end to form a loop.

15. The anchor system of claim 11 wherein said other end includes another extension projecting therefrom.

16. The anchor system of claim 15 wherein said other extension has a free end, said free end being disposed within the interior of said tubular member adjacent said other end to form a loop.

17. A method of securing a rope to an anchor point at an elevated location so that a portion of said rope may extend from said elevated location to some point therebelow, said method comprising releasably securing slidable connection means to said fixed anchor point, said slidable connection means comprising a flexible tubular member woven of strands of fibers, said tubular member having a pair of ends, a first one of said ends including an extension projecting therefrom, said one extension comprising a connector, said method additionally comprising releasably securing said connector to said fixed anchor point, extending said rope means through said tubular member, said tubular member having a sufficiently large internal diameter that said rope means may slide therethrough, pulling on said ends so that the internal diameter of said tubular member is contracted radially inward, whereupon said internal diameter is reduced so that said rope means is tightly frictionally engaged by said tubular member to preclude said rope means from sliding through said tubular member.

18. The method of claim 17 wherein said one extension has a free end, said method additionally comprising disposing said free end within the interior of said tubular member adjacent said one end to form a loop.

19. The method of claim 18 wherein said other end includes another extension projecting therefrom, said other extension having a free end, and wherein said method additionally comprises disposing said free end of said other extension within the interior of said tubular member adjacent said other end to form a loop.

20. The method of claim 19 wherein said connector is releasably secured on the loop formed by said one extension.

21. A slidable connection device being arranged to be releasably secured to a rope or cable, said device comprising a flexible tubular member woven of strands of fibers and having a pair of ends, each of said ends including an opening and an extension projecting therefrom, each of said extensions having a free end portion bent back over itself and inserted into its respective opening to form a loop, said tubular member when compressed longitudinally having a sufficiently large internal diameter that said rope or cable may slide therethrough, said tubular member being arranged to be extended longitudinally upon the application of a pulling force to each of said loops, whereupon said internal diameter is reduced so that said rope or cable is tightly frictionally engaged by said tubular member to preclude said rope means from sliding through said tubular member.

22. The device of claim 21 wherein a connector is releasably secured to at least one of said loops.

* * * * *